United States Patent [19]

Faller

[11] 4,349,124

[45] Sep. 14, 1982

[54] COMPOSITE PAPERBOARD TRAY

[75] Inventor: Rudolph A. Faller, Edina, Minn.

[73] Assignee: Champion International Corporation, Stamford, Conn.

[21] Appl. No.: 189,099

[22] Filed: Sep. 22, 1980

[51] Int. Cl.[3] ..... B65D 1/42; B65D 5/56; B65D 6/38; B65D 8/12

[52] U.S. Cl. ..... 220/453; 220/72; 220/458; 229/2.5 R; 229/3.1

[58] Field of Search ..... 220/72, 453, 456, 457, 220/458; 229/2.5 R, 3.1, 3.5 MF, 1.5 B

[56] References Cited

U.S. PATENT DOCUMENTS

| | | | |
|---|---|---|---|
| 3,113,710 | 12/1963 | Meagher | 229/2.5 R |
| 3,182,882 | 5/1965 | Aellen, Jr. et al. | 229/1.5 B X |
| 3,233,813 | 2/1966 | Wolford et al. | 229/3.5 MF |
| 3,442,420 | 5/1969 | Edwards | 229/1.5 B X |
| 3,443,715 | 5/1969 | Edwards | 220/468 X |
| 3,834,606 | 9/1974 | Andersson | 229/2.5 |
| 4,026,458 | 5/1977 | Morris et al. | 220/458 X |

FOREIGN PATENT DOCUMENTS

| | | | |
|---|---|---|---|
| 1253019 | 12/1960 | France | 229/2.5 R |

*Primary Examiner*—Allan N. Shoap
*Attorney, Agent, or Firm*—Evelyn M. Sommer

[57] ABSTRACT

A composite tray is formed from top and bottom press formed tray members. The top tray member includes a base and sidewalls, and a plurality of embossments or raised surfaces are formed on the base thereof, while the bottom tray member also includes a base and sidewalls, with a plurality of debossments formed on the base thereof. The bottom tray member is of slightly larger dimensions than the top tray member such that the top tray member may be fitted within the bottom tray member and affixed thereto. The opposed bases of the top and bottom trays cooperate to inhibit unwanted twisting or flexing of the composite tray, thereby enhancing the structural rigidity of the tray. In a preferred embodiment of the subject invention, the bases in the top and bottom tray members are disposed in mirror image relationship to further rigidify the composite tray. Polymer coatings may be provided on the exposed surfaces of the composite tray to provide a moisture-liquid barrier. Methods of making the embodiments of the composite tray are also disclosed.

7 Claims, 6 Drawing Figures

COMPOSITE PAPERBOARD TRAY

BACKGROUND OF THE INVENTION

The present invention relates to a composite tray and to a method for forming same. More particularly, the present invention relates to a composite tray formed from two tray members having opposed bosses or bossments such that when the members are secured together, a rigid composite tray is formed.

In restaurants, particularly of the cafeteria type, it is useful to have an inexpensive, disposable tray which may be used to contain food while it is being heated in an apparatus such as a steam table. The tray must be relatively rigid in order to contain the food and enable the food to be transported. Further, the tray should be relatively impermeable to the moisture and fats in food, as well as the hot vapors rising from the steam table.

SUMMARY OF THE INVENTION

Accordingly, it is an object of the subject invention to provide a new and improved composite tray which has improved structural rigidity.

It is a further object of the subject invention to provide a composite tray which is relatively impermeable to liquids, moisture, fats and oils.

It is another object of the subject invention to provide a composite tray formed from top and bottom tray members having opposed bosses for increasing the structural rigidity of the composite tray.

It is still a further object of the subject invention to provide a method of making a composite tray that is rigid, lightweight, and relatively inexpensive to manufacture.

In accordance with the subject invention, a composite tray is provided which consists of top and bottom tray members which are interfit to provide a composite tray having increased structural rigidity. More particularly, a top tray member is provided having a plurality of embossments formed on the base portion thereof. A bottom tray member, of slightly larger dimensions than the top tray member, is provided with a plurality of debossments formed on the base portion thereof. The top tray member is interfit with the bottom tray member and adhesively connected thereto. The opposed embossments and debossments of the tray members cooperate to increase the rigidity of the composite tray by reducing the tendency of the tray to twist or flex. In a preferred embodiment of the subject invention, the opposed embossments and debossments of the tray members are oriented in mirror image relationship to provide additional structural rigidity for the composite tray. In order to increase the resistance of the composite tray to moisture, fats and oils, each top and bottom tray member is formed by die cutting and creasing paperboard having a polymer coating (such as polyethylene terephthalate) on one side, and then subjecting it to pressure between a male die and a heated female die. The male die is more or less at ambient temperature, and it is the male die which bears against the polymer coated surface of the coated paperboard. The heated female die (which bears against the paperboard) facilitates the formation of the bosses on the bottom of the tray member.

In other embodiments, the top tray may be formed as just described, but the bottom tray can be made exactly opposite of the top tray, e.g. by reversing the paperboard and pressing down the polymer coated surface to the bottom of the die and by using a heated male die and a cool female mold thereby producing a composite tray with polymer surfaces on both sides; a composite tray could be produced in which the bottom tray did not have a plastic liner. The composite tray having the greatest functional resistance to moisture, fats and oils is that one having both polymer coated surfaces facing outwardly.

Further objects and advantages and salient features of the subject invention will become apparent from the following detailed description which, taken in conjunction with the accompanying drawings, discloses preferred embodiments of the subject invention.

BRIEF DESCRIPTION OF THE DRAWINGS ;p

DETAILED DESCRIPTION OF THE PREFERRED EMBODIMENTS

Figure 1:
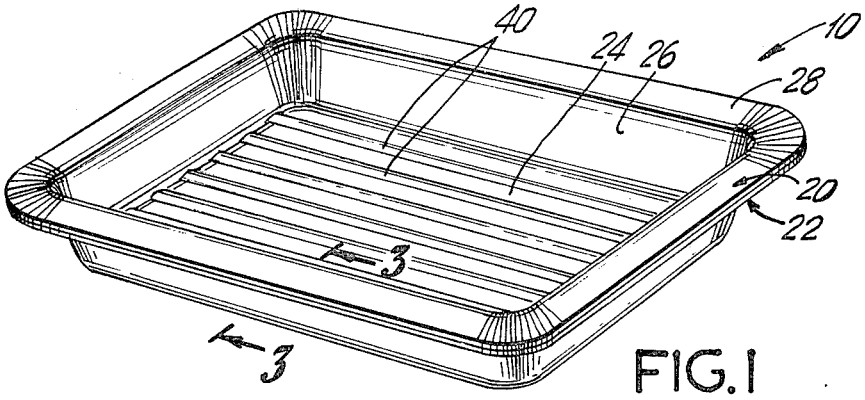
FIG. 1 is a perspective view of a first embodiment of a composite paperboard tray of the subject invention.
Figure 2:
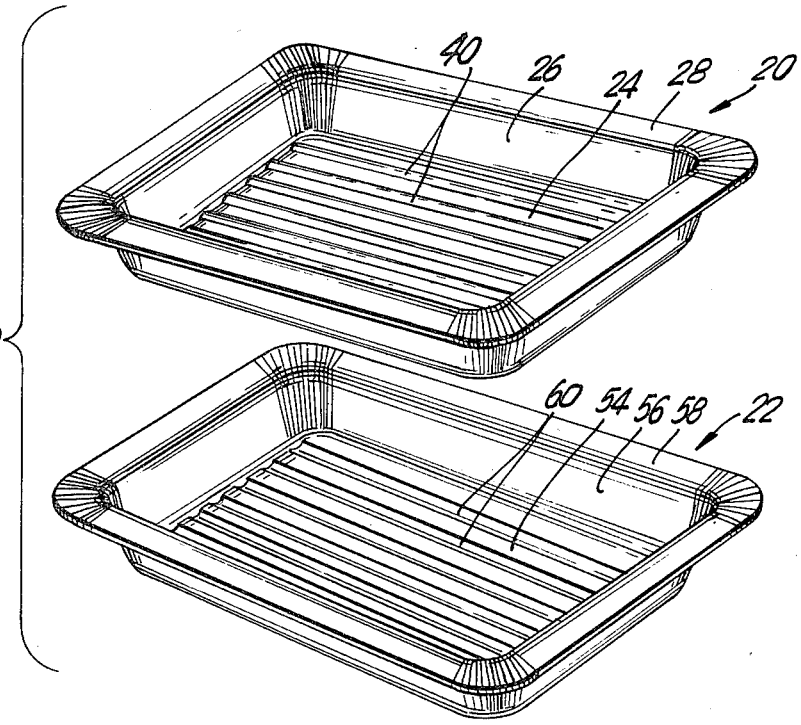
FIG. 2 is an exploded perspective view of the top and bottom tray members forming the composite paperboard tray of FIG. 1.
Figure 3:
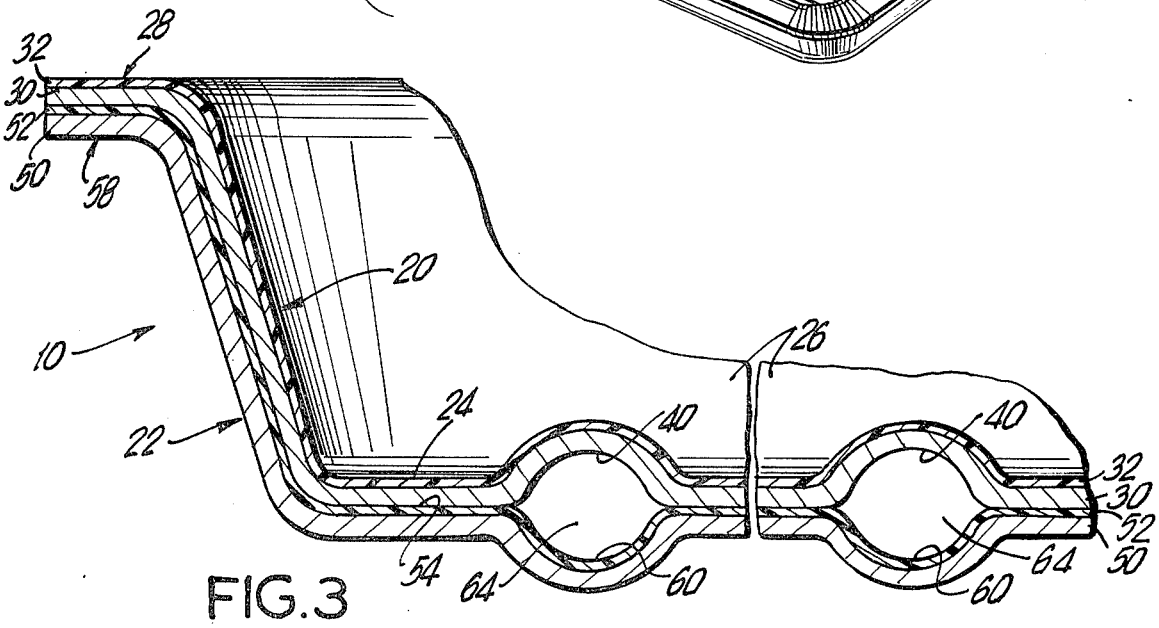
FIG. 3 is an enlarged, cross sectional view of a composite tray of the subject invention, taken along the line 3—3 in FIG. 1.

Turning to FIGS. 1, 2, and 3, the first embodiment of the composite tray of the subject invention is generally designated by the numeral 10, and includes a top tray member 20 and a bottom tray member 22. The cross-sectional dimensions of the bottom tray member 22 are slightly larger than the cross-sectional dimensions of the top tray member 20, such that the tray members are interfit to form the composite tray 10. Each tray member 20, 22 is preferably formed from a paperboard material, such as medium density fiberboard, which is coated with a polymer such as polyethylene terephthalate, and the coated paperboard is die-cut and creased prior to being subjected to pressure in a press forming machine. The resulting tray member is press formed by a process wherein the die-cut and creased paperboard with polymer coating is subjected to pressure between a male die and a heated female die. The male die is more or less at ambient temperature and is pressed against the polymer coated surface of the paperboard, while the heated female die is pressed directly against the paperboard surface and facilitates the formation of bossments on the bottom or base of the resulting press formed tray, as more particularly described hereinafter. It is noted that the male die adjacent to the polymer coated surface of the coated paperboard is cool in order to prevent moisture which is in the paperboard from turning into steam immediately underneath the plastic coating which could result in an unwanted separation between the lamination of the plastic coating and the paperboard material. In the case of the other embodiments, as for example, where the polymer coated surface of the bottom tray is to be the outer surface, the heat would have to be reversed during the forming.

As more particularly illustrated in FIGS. 2 and 3, the upper tray member 20 includes a generally rectangular base area 24, upstanding sidewalls 26, and a continuous flange structure 28. The press form tray member 20 is made of a lamination of paperboard material 30 coated on one surface with a polymer 32, such as polyethylene teraphthalate. In the press formation of the top tray member 20, the heated female die includes raised surfaces, while the ambient temperature male die is provided with matching recessed surfaces, whereby the resulting top tray member 20 includes a plurality of parallel embossments, designated by the numeral 40, formed in the base 24 of the tray member 20.

The bottom tray member 22 is also formed of a paperboard material 50 to which is laminated or extrusion bonded a polymer coating 52, such as polyethylene terephthalate, and includes a base 54, upstanding sidewalls 56, and a continuous flange structure 58. In the press forming of the bottom tray member 22, the male die of the press forming apparatus would have raised surfaces, and the heated female die would have matched recessed areas, thereby resulting in a plurality of generally parallel debossments 60 formed in the base 54 of the bottom tray member 22.

In accordance with the subject invention, in order to reduce the flexibility or twist of the composite tray member 10, thereby enabling the composite tray to support and hold heavier items, the upper and lower tray members 20 and 22 are respectively provided with the plurality of opposed embossments 40 and debossments 60 which, when the composite tray 10 is assembled, act similar to corrugations to stiffen the composite tray. In the assembly of the composite tray 10, the top tray member 20 is placed within the bottom tray member 22, and since the opposed bossments 40, 60 are in mirror relationship, they cooperate to define a plurality of longitudinally extending air pockets 64. These air pockets provide additional structural rigidity for the composite tray.

The top tray member 20 may be securely affixed to the bottom tray member 22 by a suitable adhesive applied between the opposed flange structures 28, 58, and to the other interfaces between the top tray member 20 and the bottom tray member 22. Bonding of the tray members 20, 22 at the points along their opposed base surfaces 24, 54 (between air pockets 64) increases the rigidity of the composite tray 10 by further reducing the tendency of the base of the composite tray 10 to flex under twisting forces.

In use, the composite tray 10 may be filled with food and placed in a steam table to keep the food warm. The polymer coating 32 on the upper surface of the top tray member provides a barrier against the penetration of moisture, oils and fats, thereby further aiding in maintaining the structural integrity of the composite tray 10. As noted above when the composite tray is picked up or carried, the aligned bossments 40, 60, which cooperate to define the air pocket 64, resist the tendency of the composite tray 10 to twist or distort.

The size and the shape of the bossments 40, 60 may be varied according to the desired use of the composite tray, as well as the physical characteristics of the coated paperboard, such as the grain ratios. The height or depth of the bossments 40, 60 are generally restricted by the amount to which the coated paperboard may be press formed. However, relatively large variations in the width and shape of the bossments are possible.

Figure 4:
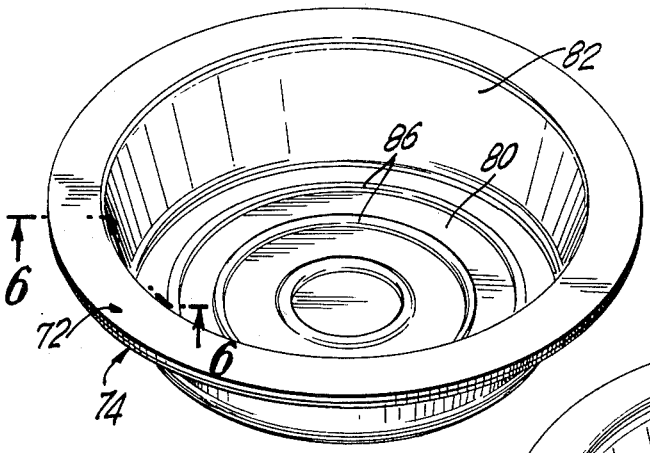
FIG. 4 is a perspective view of a second embodiment of the composite paperboard tray of the subject invention.
Figure 5:
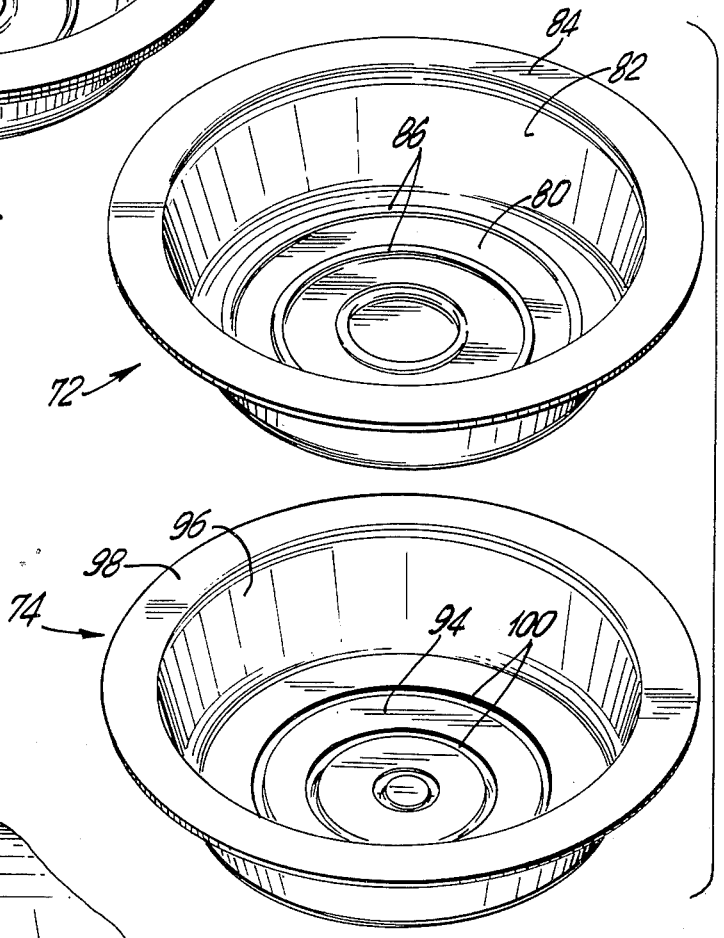
FIG. 5 is an exploded perspective view of the top and bottom tray members forming the composite paperboard tray of FIG. 4.
Figure 6:
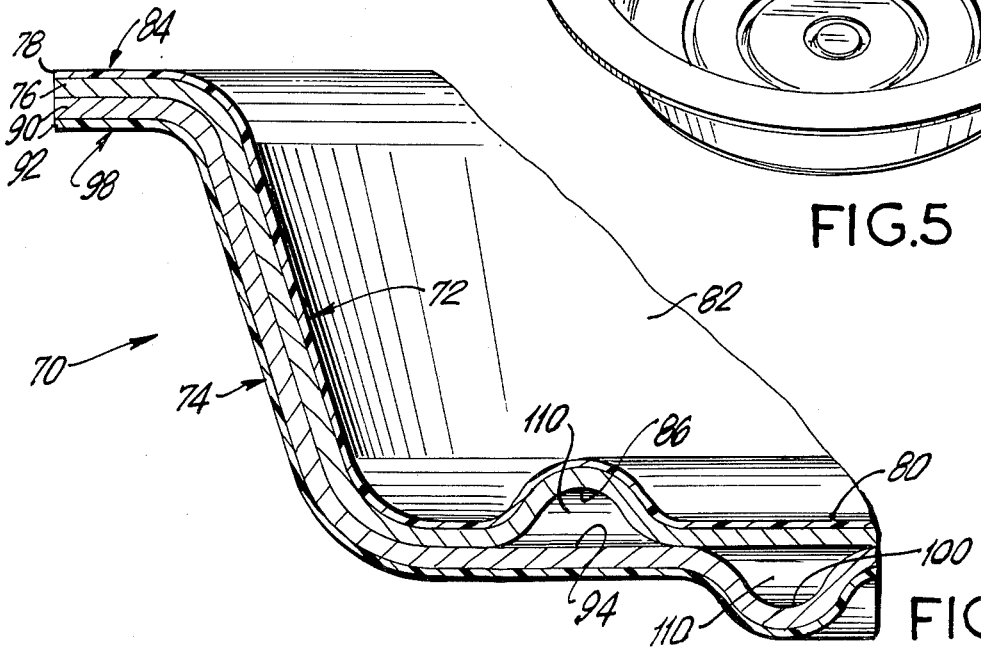
FIG. 6 is an enlarged, cross sectional view of the second embodiment of the composite tray of the subject invention, taken along line 6—6 in FIG. 4.

Turning now more specifically to FIGS. 4, 5 and 6, a second embodiment of the composite tray 70 of the subject invention is illustrated and includes a generally circular top tray member 72, as well as a circular bottom tray member 74 of slightly larger dimensions. The top tray member 72 is press formed from medium density paperboard 76 which is coated with a polymer 78, such as polyethylene terephthalate, and includes a generally circular bottom area 80, an upstanding side wall 82, and an annular flange 84 circumscribing the periphery of the upper edge of the side wall 82. As illustrated in FIG. 6, the angle of the side wall 82 relative to the bottom area 80 is approximately 17° away from the vertical. This angle is the result of the press forming operation.

Bottom tray member 74 has slightly larger dimensions than the top tray member 72, and is also formed of medium density paperboard 90 which is coated with a polymer 92, with the bottom tray member 74 including a base 94, side wall 96, and a continuous flange 98.

In accordance with the subject invention, the contiguous base surfaces of the top and bottom tray members 72 and 74 are provided with bossments for increasing the structural rigidity of the composite tray 70. More particularly, the top tray member 72 is provided with a plurality of embossments 86 which are annular in configuration and are arranged in concentric rings along the base surface 80 of the top tray 72. In like manner, the base surface 94 of the bottom tray member 74 is provided with a plurality of annular debossments 100 arranged in concentric rings. After the top and bottom tray members have been formed with the respective bossments 86, 100, the top tray member 72 is fitted within the bottom tray member 74 and adhesively connected thereto. The adhesive may be placed between the opposed surfaces of the respective tray members adjacent the flange areas 84, 98, as well as in other abutting portions of the tray members. As specifically shown in FIG. 6, the embossments 86 and the debossments 100 are not aligned in mirror image relationship, as is the configuration in the first embodiment of the subject invention as illustrated in FIGS. 1 through 3. In contrast, the embossments 86 of the top tray member 72 have dissimilar radii as compared to the concentric debossments 100 of the bottom tray member 74. As illustrated in FIG. 6, each embossment 86 in the top tray member 72 is disposed over a flat or non-debossed portion of the base surface 94 of the bottom tray member 74. Conversely, debossments 100 of the bottom tray member 74 are disposed below a non-embossed area of the base surface 80 of the upper tray member 72. By this arrangement, a series of semi-circular air pockets 110 are formed in the base of the composite tray 70, and such semicircular air pockets 110 function to substantially reduce the unwanted twisting or flexing of the bottom of the composite tray 70. Although the bossments 86, 100 in the embodiment illustrated in FIGS. 4 through 6 are shown as annular concentric rings, the scope of the subject invention is not intended to be limited to such an arrangement, but should include various other shapes and orientations which will provide the desired structural rigidity and integrity to the composite tray 70 in order to accomplish the intended use of the tray.

It is noted that the top tray member 72 is formed such that the polymer coating 78 is exposed so as to act as a barrier against water, oils and fats or foods or other products placed within the composite tray 70. It is also noted that the polymer coating 92 of the bottom tray member is exposed, and thus ensures that the bottom surface of the composite tray 70 is impervious to moisture, oils and fats, and this is highly desirable when the composite tray 70 is used in steam table applications where hot vapors rise upward and contact the bottom surface of the composite tray. In other words, by placing the polymer coating 92 on the bottom of the composite tray, the latter is rendered highly resistant to breakdown due to hot vapors. It is preferable that the polymer coatings 78 and 92 be formed from polyethylene terephthalate which has a relatively high melting point.

In summary, a new and improved composite tray is disclosed which is particularly suitable for use in restaurant facilities and cafeterias where food is contained in trays which are then placed in steam tables for keeping food hot. More particularly, a composite tray is provided wherein top tray member is formed having a plurality of embossments on the base surface thereof. A bottom tray member of slightly larger dimensions than top tray member is provided with a plurality of debossments formed on the base surface thereof. The top tray member is disposed within the bottom tray member and fixedly coupled thereto such that the bossments cooperate to increase the structural rigidity of the tray. In a preferred embodiment of the subject invention, the bossments are in mirror image relationship to define generally annular air pockets. In the alternative embodiment, the respective bossments are not aligned whereby semi-circular air pockets are defined. The composite tray is preferably made of top and bottom press formed members, each being press formed from polymer coated paperboard, with the polymer coatings functioning to increase the resistance of the composite tray to aqueous and fatty foods. While the preferred embodiments have been described as comprised of tray members formed of medium density paperboard, other paperboards including low density board press form equally well. In this same context, in addition to polymer coatings of polyethylene terephthalate, depending on the end use, polyethylene, polypropylene can be extrusion coated to the board. In addition to being particularly suitable for use in connection with restaurant facilities and cafeterias, the composite tray of the subject invention may also find applications in health care such as bed pans in nursing homes and hospitals.

While particular embodiments have been chosen to illustrate the invention, it will be understood by those skilled in this art that various changes and modifications can be made therein without departing from the scope of the invention as defined by the appended claims.

What is claimed is:

1. A composite tray comprising:

a top tray member press formed from paperboard material having a polymer coating on one side, said top tray member including a base surface, a continuous upstanding outwardly tapering side wall extending from said base surface, and a continuous peripheral flange extending outwardly from said side wall substantially parallel to said base surface, said top tray further including a plurality of elongated embossments formed on the base surface thereof and projecting toward the plane of said peripheral flange, said paperboard material being oriented such that said polymer coating is disposed on the convex side of said embossments; and a bottom tray member press formed from paperboard material having a polymer coating on one side, said bottom tray member having a configuration substantially identical to the configuration of said top tray member but having slightly larger dimensions than said top tray member and having a plurality of elongated debossments formed on the base surface thereof and projecting away from the plane of the peripheral flange, said top tray member being disposed within said bottom tray member and fixedly connected thereto along the peripheral flanges, the side walls and the portions of the base surfaces between the bossments such that said bossments cooperate with the opposing base surface to define elongated enclosed portions that increase the structural rigidity of the composite tray.

2. A composite tray as recited in claim 1 wherein the respective bossments of said top and bottom tray members are disposed in mirror image relationship.

3. A composite tray as recited in claim 1 wherein said bossments are annular in configuration.

4. A composite tray as recited in claim 1 wherein said polymer coating is polyethylene terephahtlate.

5. A composite tray as recited in claim 1 wherein the polymer coating is disposed on the exposed surface of said bottom tray member such that said polymer coating functions as a moisture-oil barrier.

6. A composite tray as recited in claim 1 wherein the polymer coating on said bottom tray member is disposed on the surface of said bottom tray member adjacent said top tray member.

7. A composite tray as recited in claim 1 wherein said bossments extend arcuately out of the plane of the base surfaces of said top and bottom tray members.

* * * * *